US010656584B2

(12) United States Patent
Hirose

(10) Patent No.: US 10,656,584 B2
(45) Date of Patent: May 19, 2020

(54) IMAGE FORMING APPARATUS AND CONTROL METHOD

(71) Applicant: CANON KABUSHIKI KAISHA, Tokyo (JP)

(72) Inventor: Fumiaki Hirose, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/160,273

(22) Filed: Oct. 15, 2018

(65) Prior Publication Data

US 2019/0049886 A1 Feb. 14, 2019

Related U.S. Application Data

(63) Continuation of application No. 15/892,277, filed on Feb. 8, 2018.

(30) Foreign Application Priority Data

Feb. 24, 2017 (JP) ..... 2017-033724

(51) Int. Cl.
*G03G 15/08* (2006.01)
*G03G 15/00* (2006.01)
*G03G 21/14* (2006.01)

(52) U.S. Cl.
CPC ..... *G03G 15/5062* (2013.01); *G03G 15/08* (2013.01); *G03G 15/0862* (2013.01); *G03G 15/0867* (2013.01); *G03G 15/0877* (2013.01); *G03G 15/5033* (2013.01); *G03G 15/5041* (2013.01); *G03G 15/5087* (2013.01); *G03G 15/556* (2013.01); *G03G 21/14* (2013.01)

(58) Field of Classification Search
CPC ..... G03G 15/08; G03G 15/0862; G03G 15/0865; G03G 15/0867; G03G 15/5041; G03G 15/5087; G03G 15/556; G03G 21/14; G03G 15/5062; G03G 15/0877; G03G 15/5033
See application file for complete search history.

(56) References Cited

FOREIGN PATENT DOCUMENTS

JP 2012168461 A * 9/2012 ..... G03G 21/00

* cited by examiner

*Primary Examiner* — Hoang X Ngo
(74) *Attorney, Agent, or Firm* — Canon U.S.A., Inc. IP Division

(57) ABSTRACT

A video count value is acquired per unit area predetermined in a direction in which a recording medium is conveyed, based on recording target image data. When an image has been formed on an area of the recording medium from which the video count value has been acquired, control is performed by using the acquired video count value so that a developing unit is replenished with an amount of toner corresponding to the video count value acquired from the area.

12 Claims, 12 Drawing Sheets

COUNT VALUE (Y) OF WHICH PRINT UNIT IS NOTIFIED: 0x0001

COUNT VALUE (M) OF WHICH PRINT UNIT IS NOTIFIED: 0x001E

COUNT VALUE (C) OF WHICH PRINT UNIT IS NOTIFIED: 0x000A

COUNT VALUE (K) OF WHICH PRINT UNIT IS NOTIFIED: 0x0003

COMMAND NUMBER: 0xA0A1
SIZE: 0x0C
COLOR: 0x0F(YMCK)
COUNT VALUE: 0x0001, 0x001E, 0x000A, 0x0003

COMMAND NUMBER: 0xA0A1
SIZE: 0x34
COLOR: 0x0F(YMCK)
COUNT VALUE: Y: 0x0001, 0x0000, 0x0005, 0x0002, 0x0003, 0x0002
M: 0x0005, 0x0003, 0x0001, 0x0000, 0x0000, 0x0005
C: 0x0002, 0x0000, 0x0001, 0x0000, 0x0001, 0x0001
K: 0x0003, 0x0005, 0x0001, 0x0004, 0x0001, 0x0002

| | | | | | | | | |
|---|---|---|---|---|---|---|---|---|
| A0 | A1 | 34 | 0F | 00 | 01 | 00 | 00 | COMMAND |
| 00 | 05 | 00 | 02 | 00 | 03 | 00 | 02 | |
| 00 | 05 | 00 | 03 | 00 | 01 | 00 | 00 | |
| 00 | 00 | 00 | 05 | 00 | 02 | 00 | 00 | |
| 00 | 01 | 00 | 00 | 00 | 01 | 00 | 01 | |
| 00 | 03 | 00 | 05 | 00 | 01 | 00 | 04 | |
| 00 | 01 | 00 | 02 | | | | | |

COMMAND SIZE: 0x34
COMMAND NUMBER: 0xA0A1
COLOR: 0x0F(YMCK)

| | | | | | | | | |
|---|---|---|---|---|---|---|---|---|
| A0 | A1 | 34 | 0F | | | | | |
| | | | | 00 | 01 | 00 | 00 | COUNT VALUE (Y) |
| 00 | 05 | 00 | 02 | 00 | 03 | 00 | 02 | |
| 00 | 05 | 00 | 03 | 00 | 01 | 00 | 00 | COUNT VALUE (M) |
| 00 | 00 | 00 | 05 | | | | | |
| | | | | 00 | 02 | 00 | 00 | COUNT VALUE (C) |
| 00 | 01 | 00 | 00 | 00 | 01 | 00 | 01 | |
| 00 | 03 | 00 | 05 | 00 | 01 | 00 | 04 | COUNT VALUE (K) |
| 00 | 01 | 00 | 02 | | | | | |

IMAGE FORMING APPARATUS AND CONTROL METHOD

CROSS REFERENCE TO RELATED APPLICATIONS

The present application is a continuation of U.S. patent application Ser. No. 15/892,277, filed on Feb. 8, 2018, which claims priority from Japanese Patent Application No. 2017-033724, filed Feb. 24, 2017, which is hereby incorporated by reference herein in its entirety.

BACKGROUND

Field

The present disclosure relates to an image forming apparatus that forms an image on a recording medium and a control method for the image forming apparatus.

Description of the Related Art

When an image forming apparatus performs print processing such as copying or personal computer (PC) printing, the image forming apparatus creates a toner image, which is an image formed by using toner agent, and fixes the created toner image on a recording medium. A printer engine of the image forming apparatus that forms such a toner image includes a development unit. The development unit includes a storage mechanism receiving toner agent from a toner bottle or a cartridge and holding the toner agent. When the image forming apparatus starts printing, the development unit outputs an amount of toner agent necessary for forming a toner image from the toner agent storage mechanism to the recording medium.

For the image forming apparatus to perform printing continuously, the development unit needs to be replenished with toner agent whose amount corresponds to the amount of toner agent that has been consumed to form a toner image. By sequentially replenishing the development unit with the consumed amount of toner agent, unevenness in image density due to a lack of toner agent is prevented. The toner agent replenishment amount is obtained by measuring a video count value, which is highly related to the amount of toner agent that has been consumed to form a toner image, and by calculating the amount of toner agent that has been consumed based on the measured value. A video count value of a toner image formed per page is acquired, and the printer engine is notified of the acquired video count value. Consequently, a toner agent replenishment amount is given to the development unit.

In recent years, there have been cases in which an image forming apparatus fails in time to replenish its storage mechanism with toner based on the video count value per page, due to various reasons such as improvement in the speed of the image forming apparatus and reduction in the capacity of the storage mechanism. In such cases, unevenness in image density can occur. Japanese Patent Application Laid-Open No. 2012-168461 discusses transmitting information about a predicted value of toner agent to be consumed along with image data.

However, according to Japanese Patent Application Laid-Open No. 2012-168461, since both image data and information about a predicted value of the image data are transmitted together, if the capacity of the storage mechanism is small, there is a possibility in which the replenishment control processing can fail to catch up with the consumed amount of toner agent in time in the middle of printing. As a result, since the capacity of the development unit needs to be increased, the cost is increased.

SUMMARY

The present disclosure is directed to an image forming apparatus and a control method that appropriately controls replenishment of toner based on image data.

According to an aspect of the present disclosure, an image forming apparatus includes an acquisition unit configured to, based on recording target image data, acquire a video count value per unit area predetermined in a direction in which a recording medium is conveyed, and a control unit configured to perform control, when an image has been formed on an area of the recording medium from which a video count value has been acquired, by using the acquired video count value so that a developing unit is replenished with an amount of toner corresponding to the video count value acquired from the area.

Further features of the present disclosure will become apparent from the following description of exemplary embodiments with reference to the attached drawings.

DESCRIPTION OF THE EMBODIMENTS

Figure 1A:
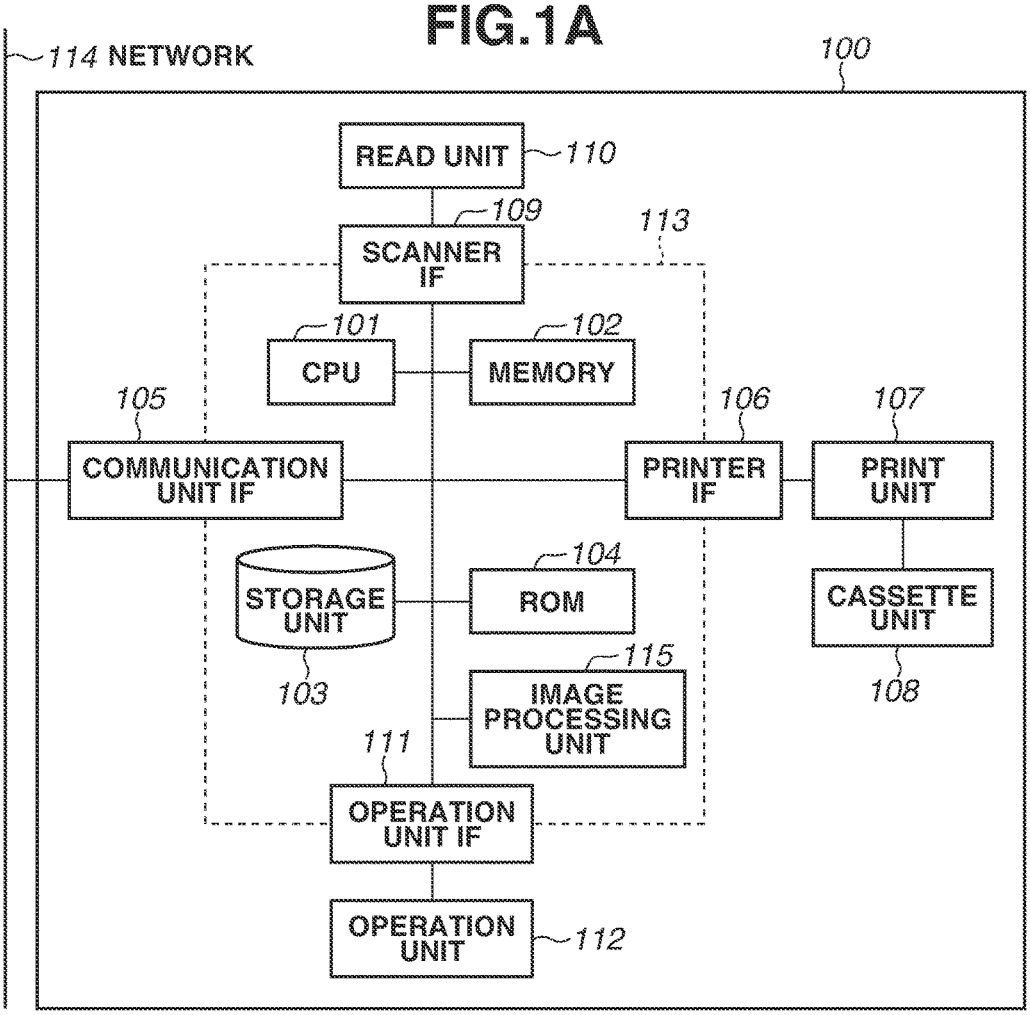
FIGS. 1A and 1B are block diagrams illustrating a configuration of an image forming apparatus.

Hereinafter, an exemplary embodiment of the will be described in detail with reference to attached drawings. The following exemplary embodiment is not seen to limit the scope of the claims. In addition, not all the combinations of features described in the exemplary embodiment are essential as the solutions according to the present disclosure. The same components will be denoted by same reference characters, and redundant description thereof will be avoided.

FIG. 1A illustrates a configuration of an image forming apparatus 100 according to an exemplary embodiment. For example, the image forming apparatus 100 is a multi-functional peripheral (MFP) including a plurality of functions such as a print function, a read function, and a facsimile (FAX) function. A controller 113 is a control board that comprehensively controls the image forming apparatus 100. A central processing unit (CPU) 101 included in the controller 113 controls a memory 102, a storage unit 103, a read-only memory (ROM) 104, and an image processing unit 115 via a system bus. The image forming apparatus 100 is connected to a network 114 such as a local area network (LAN) via a communication unit interface (IF) 105. The communication unit IF 105 includes a configuration based on a medium of the network 114 such as a wired medium or a wireless medium. The controller 113 is connected to a read unit 110 via a scanner IF 109 and to a print unit 107 and a cassette unit 108 via a printer IF 106. The controller 113 is connected to an operation unit 112 via an operation unit IF 111.

Various kinds of program and data for realizing functions of the image forming apparatus 100 are stored in the storage unit 103 such as a hard disk or a floppy disk. These programs and data are sequentially read to the memory 102 as needed and executed by the CPU 101. The storage unit 103 can be a removable storage unit or can be incorporated in the image forming apparatus 100. The programs can be downloaded from other apparatuses via the network 114 and stored in the storage unit 103. A nonvolatile memory such as a static random access memory (SRAM) or a volatile memory such as a dynamic random access memory (DRAM) is used, for example, as the memory 102. However, the memory 102 can have features of both kinds of memory. For example, the memory 102 can have a feature of a volatile memory, and the storage unit 103 can have a feature of a nonvolatile memory. Alternatively, the memory 102 can be a memory medium that can be removed from the image forming apparatus 100.

The operation unit 112 includes a touch panel, hardware keys, displays various kinds of user interface screens based on display data provided by the CPU 101, and receives settings and instructions from users. The information received by the operation unit 112 is forwarded to any one of the CPU 101, the memory 102, and the storage unit 103 and is accumulated to be used for various kinds of processing.

By reading data from the communication unit IF 105 or writing data in the communication unit IF 105, the CPU 101 can communicate with external apparatuses connected to the network 114. For example, the CPU 101 receives a print job or print target image data from an external host computer and transmits a job execution result to the host computer. Data received from the communication unit IF 105 can be stored in the memory 102 or the storage unit 103.

The CPU 101 exchanges various kinds of data such as print data and status information with the print unit 107 including a configuration of a printer engine via the printer IF 106. The print unit 107 includes, as a configuration of an electrophotographic printer engine, a configuration corresponding to each of various processes such as charging, exposure, development, transfer, and fixing and forms an image on a recording medium based on recording target image data. The CPU 101 exchanges various kinds of data such as read data or status information with the read unit 110 including a configuration of a scanner engine via the scanner IF 109. The read unit 110 includes a configuration of optically reading an original document supplied from a platen glass or an automatic document feeder (ADF), which are not illustrated in FIG. 1. For example, the read unit 110 includes an image sensor unit including a light source such as a light emitting diode (LED) and an image sensor. Read data can be stored in the memory 102 or the storage unit 103.

While data can be acquired from the communication unit IF 105 or the read unit 110, there can also be a case in which data stored in the removable memory 102 is acquired when the memory 102 is attached to the image forming apparatus 100. Data stored in the storage unit 103 can be moved or copied to the memory 102. For example, based on instructions provided via the operation unit 112, various added images can be synthesized with image data in the memory 102.

While the image forming apparatus 100 in FIG. 1A includes the print unit 107 and the read unit 110, the print unit 107 and the read unit 110 can be arranged as peripheral devices on the network 114. In such case, the controller 113 controls these peripheral devices via the communication unit IF 105.

The image processing unit 115 performs various kinds of image processing such as compression/decompression, correction, conversion, and edit on acquired data. For example, as needed, the image processing unit 115 performs image processing on read data that has been acquired by the read unit 110 or image data to be output to the print unit 107. The image processing unit 115 can be configured as a hardware or software function. Alternatively, the image processing unit 115 can include both hardware and software functions.

Figure 1B:
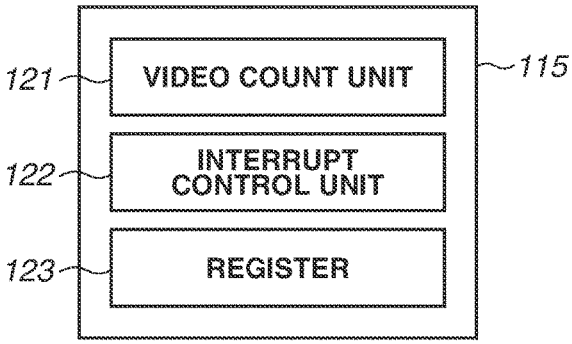

In addition, in the present exemplary embodiment, the image processing unit 115 includes a video count unit 121, an interrupt control unit 122, and a register 123 as illustrated in FIG. 1B. First, a video count value of recording target image data is acquired by the video count unit 121. Then, the acquired video count value is stored in the register 123 and read by the CPU 101. When a video count value is stored in the register 123, the interrupt control unit 122 outputs an interrupt signal indicating that the video count value has been stored in the register 123 to the CPU 101.

Figure 2A:
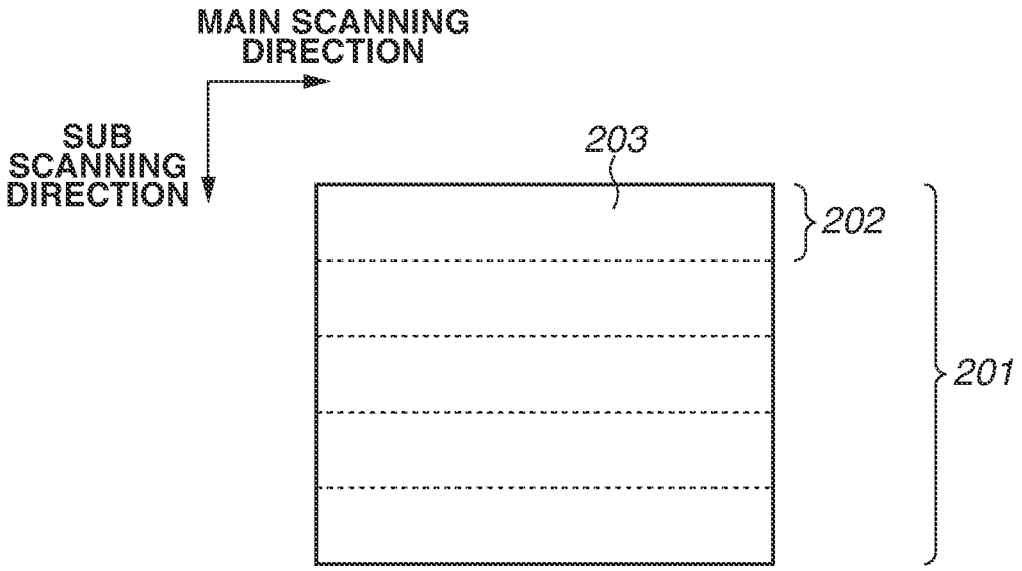
FIGS. 2A and 2B illustrate areas from which video count values are acquired.
Figure 2B:
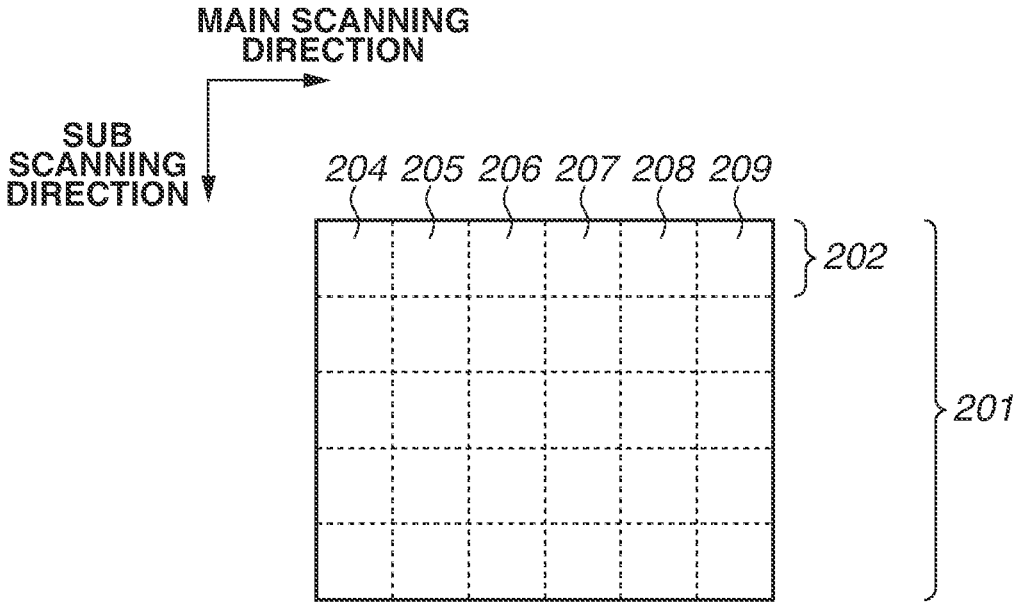

FIGS. 2A and 2B illustrate areas from which the image processing unit 115 acquires video count values. As illustrated in FIG. 2A, the image processing unit 115 divides image data 201 that has been input thereto into areas 203 arranged in a sub scanning direction and acquires a video count value per area 203. The sub scanning direction corresponds to the direction in which a recording medium is conveyed in the print unit 107. For example, an individual video count value is acquired by causing a counter to add up pulses of a clock signal corresponding to a pixel signal. An individual video count value corresponds to density per pixel. Thus, by acquiring a video count value, the amount of toner that has been consumed to develop an electrostatic latent image with toner in the print unit 107, i.e., a toner replenishment amount, can be obtained. The image processing unit 115 refers to a table in which a toner replenishment amount and a video count value are associated with each other and performs toner replenishment control processing based on a toner replenishment amount associated with a video count value acquired from image data. This table is stored in the storage unit 103, for example.

FIG. 2A illustrates an example in which the image data 201 has been divided into five areas 203 arranged in the sub scanning direction. The image processing unit 115 sequentially acquires video count values, starting with an area 203 located at one end of the image data 201 in the sub scanning direction. For example, after the image processing unit 115 acquires a video count value corresponding to 202 lines, the image processing unit 115 stores the acquired value in the register 123 as the video count value of the read areas 203. Then, the image processing unit 115 outputs an interrupt signal indicating that the video count value has been stored in the register 123 to the CPU 101.

Alternatively, the image processing unit 115 can divide the image data 201 not only in the sub scanning direction, but also a main scanning direction as illustrated in FIG. 2B and acquire the areas obtained by the division. The main scanning direction is a direction perpendicular to the sub scanning direction and corresponds to a longitudinal direction of a development sleeve in the print unit 107. FIG. 2B illustrates an example in which the image data 201 has been divided into smaller areas arranged in the sub and main scanning directions (6 columns and 5 rows) and in which the image processing unit 115 acquires video count values from areas 204 to 209, respectively. As in FIG. 2A, after the image processing unit 115 acquires video count values corresponding to 202 lines, the image processing unit 115 stores the acquired values in the register 123 as the video count values of the respective areas 204 to 209. Then the image processing unit 115 outputs an interrupt signal indicating that the video count values have been stored in the register 123 to the CPU 101.

Figure 3:
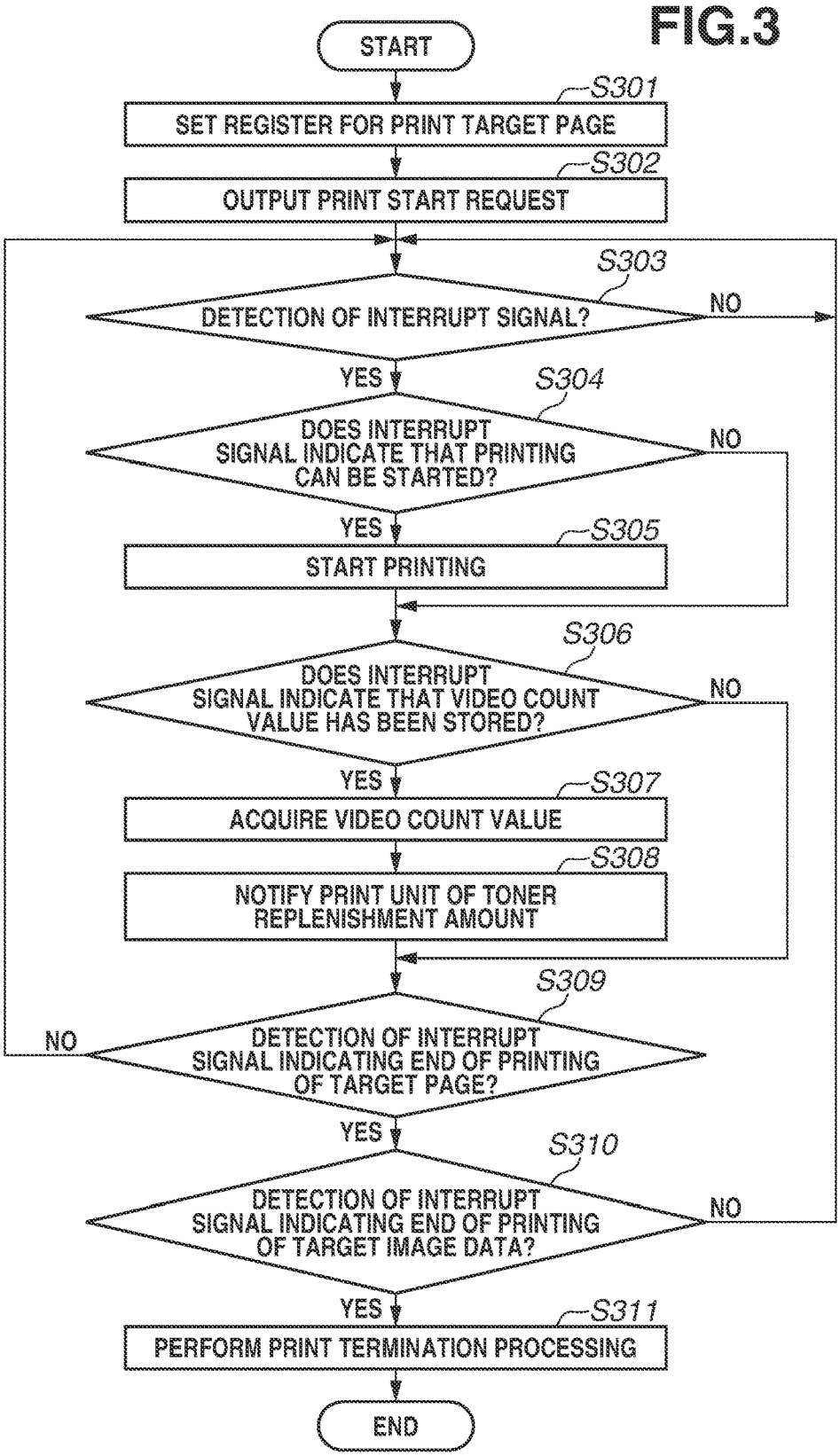
FIG. 3 is a flowchart illustrating print processing performed by the image forming apparatus.

FIG. 3 is a flowchart illustrating print processing performed by the image forming apparatus 100. For example, the processing in FIG. 3 is realized by the CPU 101 extracting an application program or the like stored in the ROM 104 to the memory 102 and executing the application program. For example, the processing in FIG. 3 is started when the CPU 101 receives an instruction for executing the print processing such as copying from a user via the operation unit 112.

In step S301, the CPU 101 instructs the image processing unit 115 to set the register for a target page of the present processing from among a plurality of pages included in print target image data. In step S302, the CPU 101 outputs a print start request to the print unit 107. When receiving the print start request from the controller 113, the print unit 107 starts a preparation operation for each unit of the printer engine. When the preparation operation is completed, the print unit 107 outputs an interrupt signal indicating that printing can be started to the controller 113.

In step S303, the CPU 101 determines whether the CPU 101 has detected an interrupt signal. The CPU 101 waits for detection of an interrupt signal (NO in step S303). If the CPU 101 detects an interrupt signal (YES in step S303), the processing proceeds to step S304. Examples of the interrupt signal include an interrupt signal that is output from the print unit 107 and that indicates that printing can be started and an interrupt signal that is output from the image processing unit 115 and that indicates that a video count value has been stored in the register.

In step S304, the CPU 101 analyzes the detected interrupt signal and determines whether the interrupt signal indicates that printing can be started. If the interrupt signal indicates that printing can be started (YES in step S304), the processing proceeds to step S305. In step S305, the CPU 101 instructs the print unit 107 to start printing. After step S305, the processing proceeds to step S306. In step S304, if the CPU 101 determines that the interrupt signal does not indicate that printing can be started (NO in step S304), the processing skips step S305 and proceeds to step S306.

In step S306, the CPU 101 analyzes the detected interrupt signal and determines whether the interrupt signal indicates that a video count value has been stored in the register 123. If the interrupt signal indicates that a video count value has been stored in the register 123 (YES in step S306), the processing proceeds to step S307. In step S307, the CPU 101 acquires the video count value from the register 123. Then, in step S308, the CPU 101 notifies the print unit 107 of a toner replenishment amount based on the acquired video count value. In step S308, the CPU 101 can notify the print unit 107 of the acquired video count value as a toner replenishment amount. After step S308, the processing proceeds to step S309. In step S306, if the interrupt signal does not indicate that a video count value has been stored in the register 123 (NO in step S306), the processing proceeds to step S309.

Since the image processing unit 115 outputs an interrupt signal each time the video count unit 121 acquires a video count value from an area 203 illustrated in FIG. 2A and stores the video count value in the register 123, the CPU 101 repeatedly acquires a video count value for each of the areas 203 arranged in the recording medium conveyance direction. In addition, as illustrated in FIG. 3, the printing of image data by the print unit 107 is not synchronized with the acquisition of a video count value by the image processing unit 115 and the notification of a toner replenishment amount to the print unit 107.

In step S309, the CPU 101 determines whether the CPU 101 has detected an interrupt signal indicating that the end of the printing of the target page of the present print processing from the print unit 107. If the CPU 101 has detected an interrupt signal indicating the end of the printing of the target page (YES in step S309), the processing proceeds to step S310. In step S310, the CPU 101 determines whether the CPU has detected an interrupt signal indicating the end of the printing of the target image data of the present print processing from the print unit 107. In step S310, if the CPU has detected an interrupt signal indicating the end of the printing of the target image data (YES in step S310), the processing proceeds to step S311. In step S311, the CPU 101 performs print termination processing on the print unit 107. If the CPU 101 has not detected an interrupt signal indicating the end of the printing of the target page (NO in step S309) or if the CPU 101 has not detected an interrupt signal indicating the end of the printing of the target image data (NO in step S310), the processing returns to step S303 to repeat the processing from step S303.

As described above, in the present exemplary embodiment, by repeating the processing in steps S303 to S309, the video count value acquisition processing in step S307 is repeated a plurality of times per page. This configuration prevents stoppage of printing or deterioration of image quality due to exhaustion of the toner remaining amount before a page is completely printed.

For example, assume that the amount of toner that remains before the image forming apparatus 100 prints a page indicates "10" (full). In addition, assume that the amounts of toner that remain when the image forming apparatus 100 has finished ¼ and ½ of the development processing in the sub scanning direction indicate "8" and "3", respectively. In this example, when the image forming apparatus 100 has finished ¾ of the development processing in the sub scanning direction, if the toner remaining amount indicates "0", the printing is stopped or the image quality is deteriorated. However, in the present exemplary embodiment, even if the toner remaining amount indicates "8" when the image forming apparatus 100 has finished ¼ of the development processing in the sub scanning direction, the same amount of toner corresponding to the consumed amount of toner "2" is supplied, the toner remaining amount indicates "full", again. In addition, even if the toner remaining amount indicates "5" when the image forming apparatus 100 has finished ½ of the development processing in the sub scanning direction, the same amount of toner corresponding to the consumed amount of toner "5" is supplied, the toner remaining amount indicates "full", again.

Figure 4:
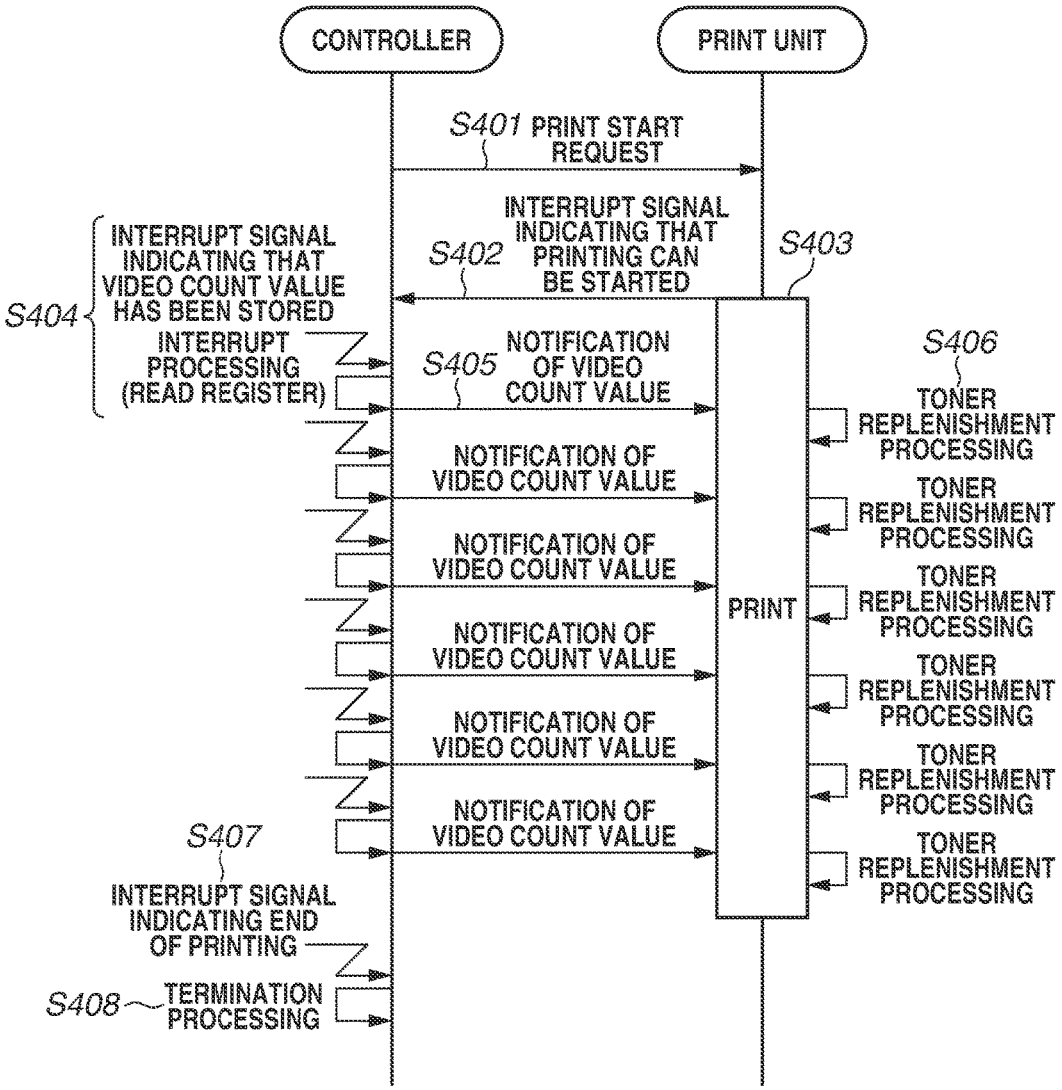
FIG. 4 is a sequence diagram illustrating processing performed between a controller and a print unit.

FIG. 4 is a sequence diagram illustrating an example of processing for printing a single page performed between the controller 113 and the print unit 107. As indicated by step S401, the controller 113 transmits a print start request to the print unit 107. This step S401 corresponds to step S302 in FIG. 3. Then, as indicated by step S402, when the print unit 107 completes preparation operations of the printer engine, the print unit 107 outputs an interrupt signal indicating that printing can be started to the controller 113. This step S402 corresponds to "YES" in step S304 in FIG. 3. Next, as indicated by step S403, the print unit 107 starts printing based on an instruction from the controller 113. This step S403 corresponds to step S305 in FIG. 3.

As the print processing in step S403 proceeds, as indicated by step S404, the controller 113 detects an interrupt signal indicating that a video count value has been stored in the register 123. This step S404 corresponds to "YES" in step S306 in FIG. 3. When the controller 113 detects the interrupt signal, the controller 113 acquires a video count value from the register 123. This step S404 corresponds to step S307 in FIG. 3. Then, as indicated by step S405, the controller 113 notifies the print unit 107 of a toner replenishment amount based on the video count value. This step S405 corresponds to step S308 in FIG. 3. Then, as indicated by step S406, when notified of the toner replenishment amount, the print unit 107 replenishes the development unit with a toner amount corresponding to the toner replenishment amount. Thereafter, the series of steps S404 to S406 is repeated a plurality of times per page.

As indicated by step S407, when the print unit 107 completes the print processing on the recording target image data, the print unit 107 outputs an interrupt signal indicating the end of the printing, and the controller 113 detects the interrupt signal. This step S407 corresponds to "YES" in step S310 in FIG. 3. Then, as indicated by step S408, the controller 113 performs print termination processing on the print unit 107. This step S408 corresponds to step S311 in FIG. 3.

Figure 5:
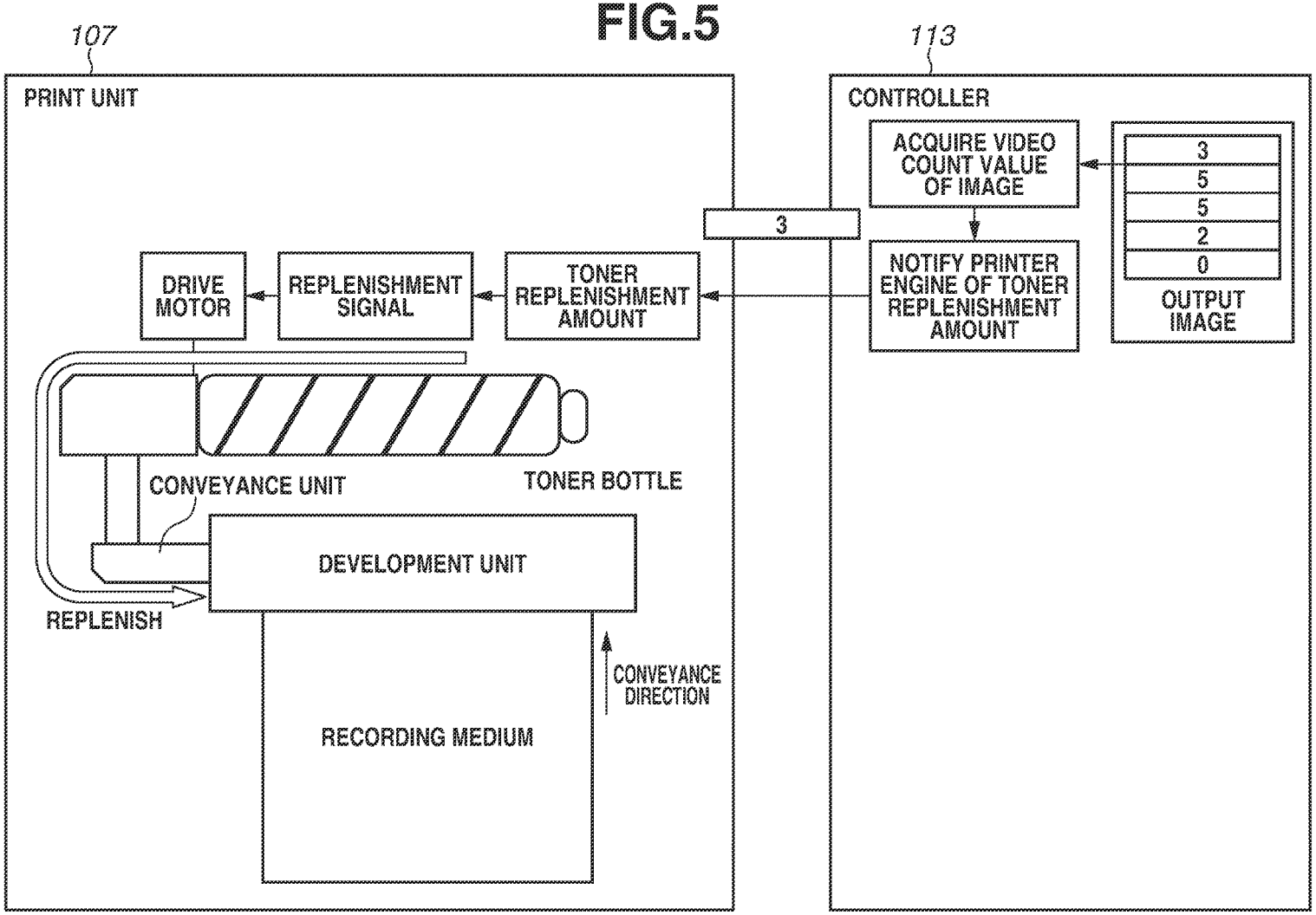
FIG. 5 schematically illustrates replenishment of toner agent.
Figure 6:
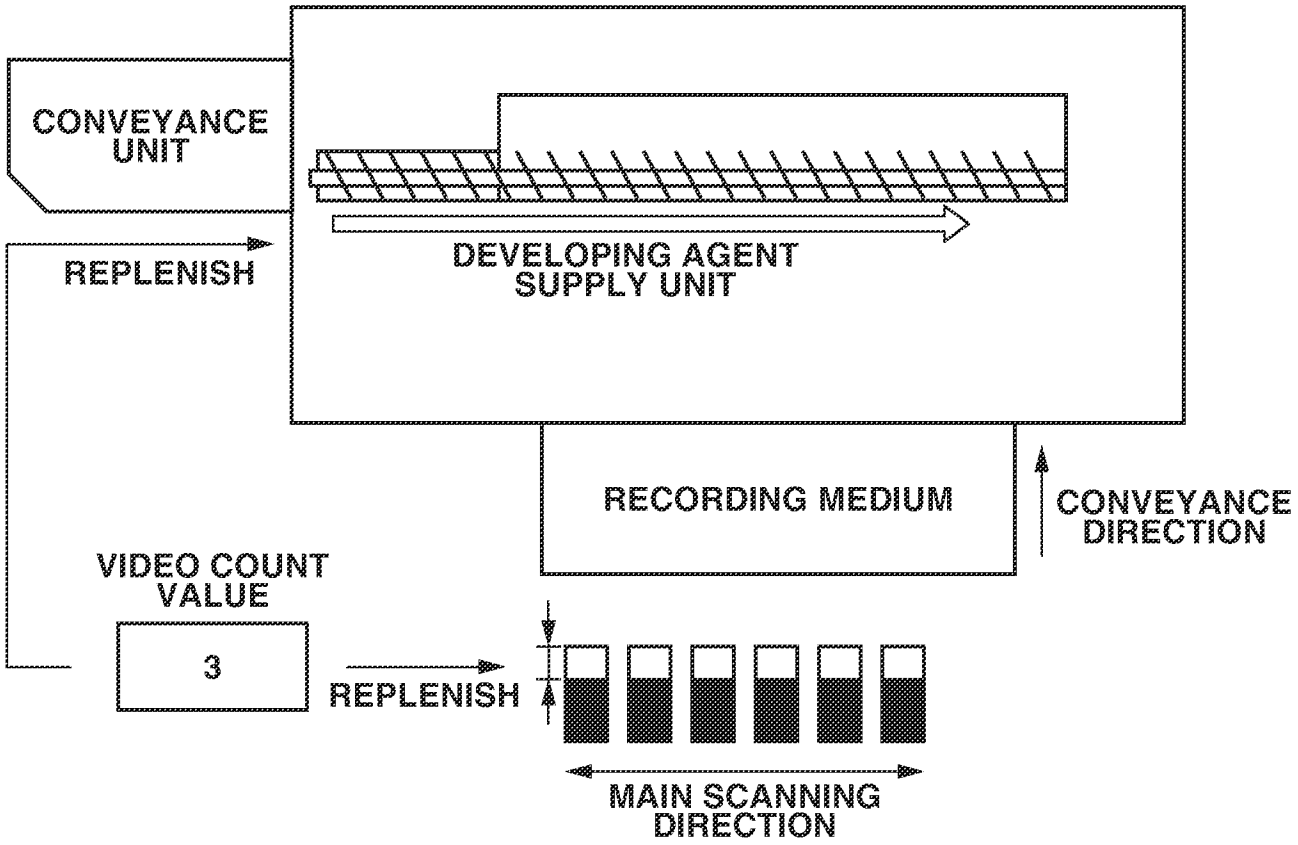
FIG. 6 schematically illustrates replenishment of toner agent.

FIGS. 5 and 6 illustrate processing in which the controller 113 notifies the print unit 107 of a video count value and the development unit (development device) is replenished with toner agent. In FIGS. 5 and 6, the processing is illustrated in association with the recording medium conveyance direction. As illustrated in FIG. 5, the controller 113 acquires a video count value per area based on recording target image data. In FIG. 5, the controller 113 acquires video count values 3, 5, 5, 2, and 0 in this order from respective areas arranged in the sub scanning direction. Then, as described with reference to FIGS. 3 and 4, the controller 113 sequentially notifies a processor in the print unit 107 of toner replenishment amounts respectively corresponding to the video count values of the individual areas.

When the processor in the print unit 107 is notified of a toner replenishment amount, the processor outputs a replenishment signal to the development unit. The processor in the print unit 107 drives a drive motor based on the replenishment signal and replenishes the development unit with toner agent from a toner bottle or a toner cartridge via a conveyance unit.

FIG. 6 illustrates components around the development unit illustrated in FIG. 5. When the development unit is replenished with toner agent, developing agent supply units inside the development unit are replenished with the toner agent. The developing agent supply units are arranged in a line in the main scanning direction and can hold toner agent used in electrostatic latent image development processing. Based on the above toner replenishment amount, each of the developing agent supply units is replenished with a certain amount of toner agent. FIG. 6 schematically illustrates replenishment of a certain amount "3" of toner agent in the main scanning direction based on the video count value "3". The replenishment of the developing agent supply units with toner agent is controlled by a mechanism of circulating developing agent and toner agent replenishment timing.

Figure 7:
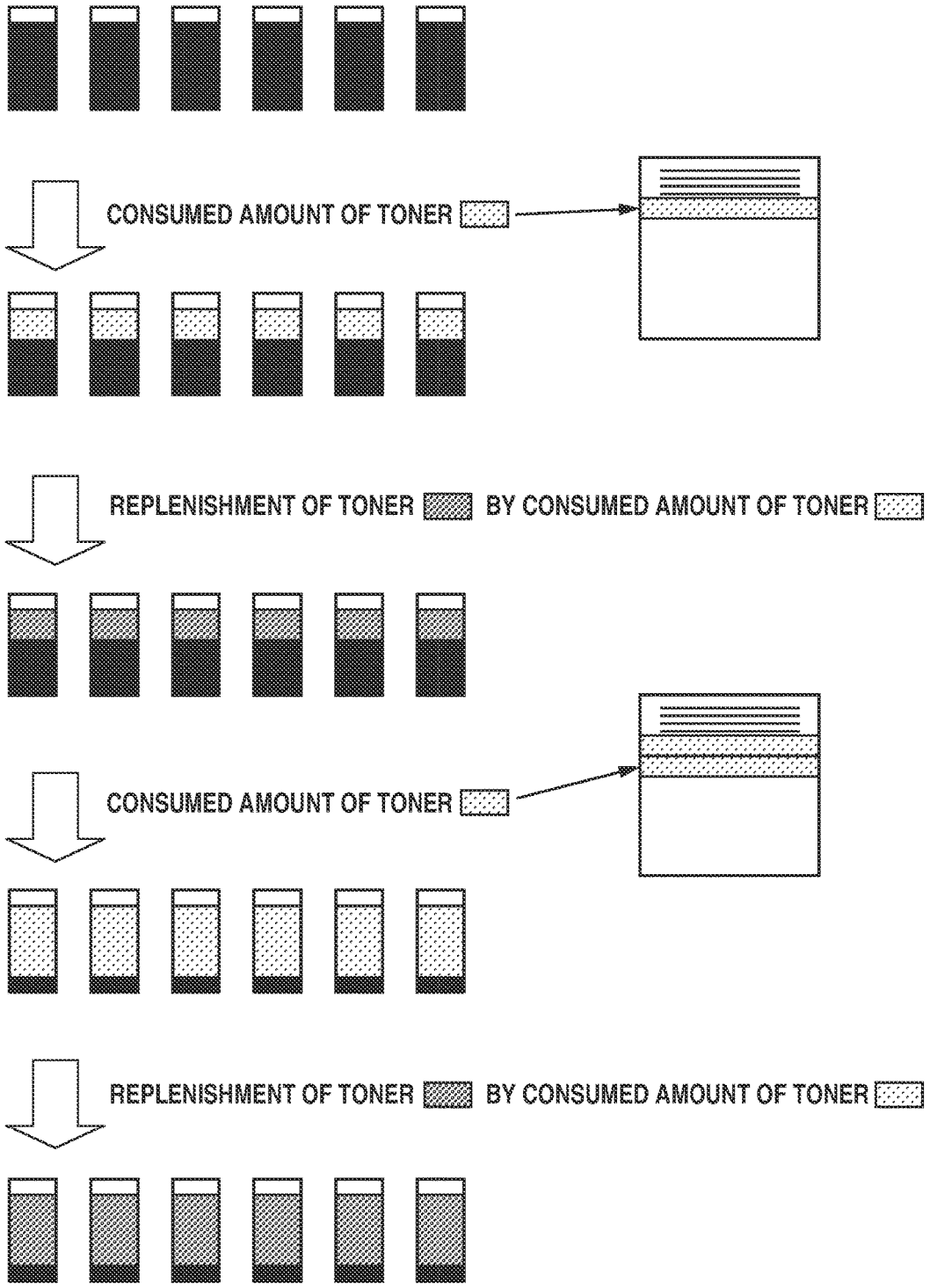
FIG. 7 illustrates processing for continuous replenishment of toner agent.

FIG. 7 illustrates processing for continuously replenishing the developing agent supply units with toner agent based on the notified toner replenishment amounts. The top part in FIG. 7 illustrates the developing agent supply units before printing is started, and these units are filled with toner agent. When the printing is started, the toner agent is consumed by the developing agent supply units as the development processing proceeds.

The second top part in FIG. 7 schematically illustrates the amount of toner agent (shaded areas) consumed from the developing agent supply units. In this case, the toner agent indicated by the shaded areas has been consumed from the developing agent supply units, and only the toner agent indicated in black has remained. The controller 113 acquires a video count value corresponding to the consumed toner agent indicated by the shaded areas and notifies the print unit 107 of a toner replenishment amount. When notified of the toner replenishment amount, as illustrated by the developing agent supply units in the third part from the top in FIG. 7, the print unit 107 replenishes the developing agent supply units in the development unit with toner agent based on a value corresponding to the toner replenishment amount specified. As a result, the developing agent supply units are filled with toner agent again.

The fourth part from the top in FIG. 7 schematically illustrates the amount of toner agent (shaded areas) subsequently consumed from the developing agent supply units. In this case, the toner agent indicated by the shaded areas has been consumed by the developing agent supply units, and only the toner agent indicated in black has remained. The controller 113 acquires a video count value corresponding to the consumed toner agent indicated by the shaded areas and notifies the print unit 107 of a toner replenishment amount. When notified of the toner replenishment amount, as illustrated by the developing agent supply units in the fifth part from the top in FIG. 7, the print unit 107 replenishes the developing agent supply units in the development unit with toner agent based on a value corresponding to the notified toner replenishment amount. As a result, the developing agent supply units are filled with toner agent again.

In the present exemplary embodiment, as described above, during printing of a single page, the print unit 107 is notified of a toner replenishment amount based on a video count value per predetermined area, and replenishment of toner agent is repeated. As a result, exhaustion of toner during printing of a page is prevented. In addition, since replenishment of toner is performed per predetermined area, the developing agent supply units can have a smaller capacity.

In the above description, the print unit 107 is notified of an acquired video count value as a toner replenishment amount. Hereinafter, a configuration in which an acquired video count value is processed and the print unit 107 is notified of a value obtained by this processing as a toner replenishment amount will be described.

Figure 8A:
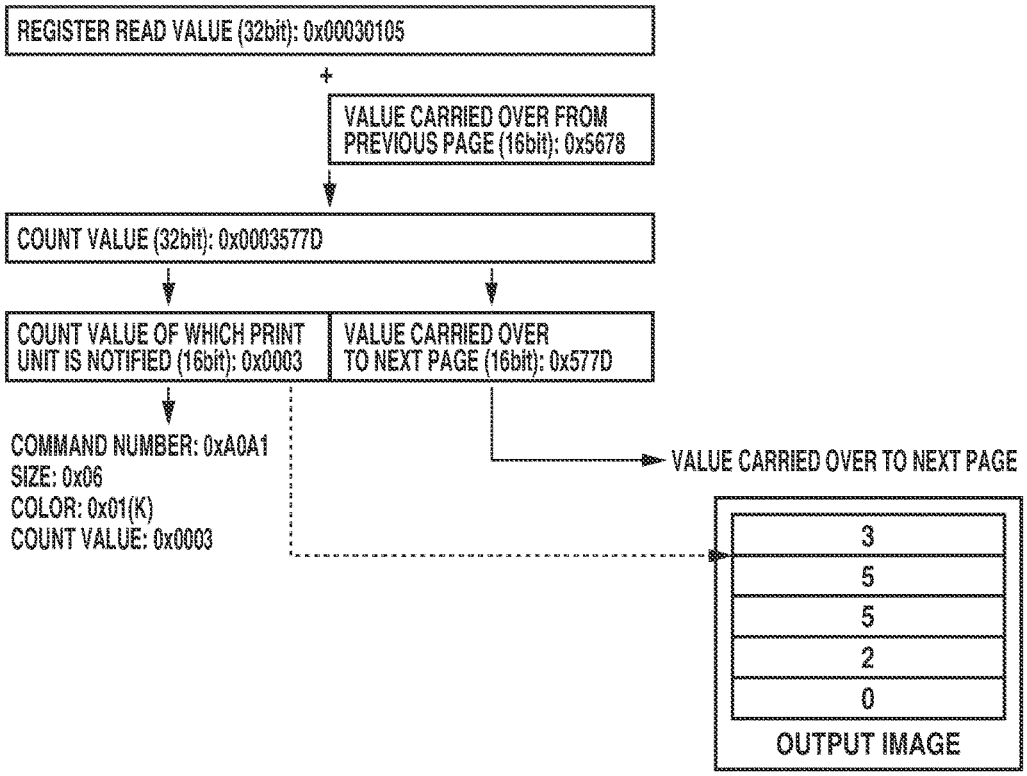
FIGS. 8A to 8C illustrate notification commands.
Figure 8B:
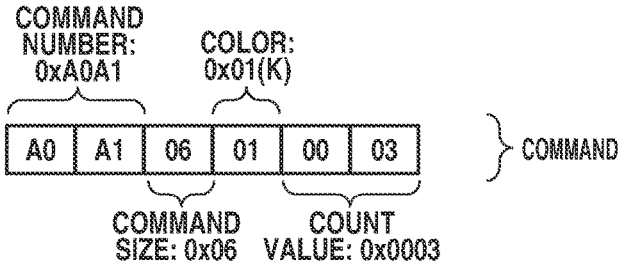
Figure 8C:
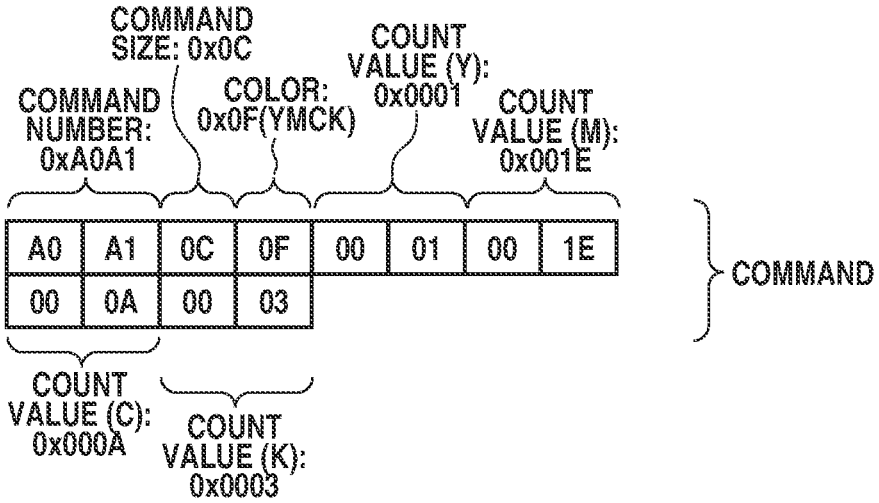

FIGS. 8A to 8C illustrate processing of video count values performed by the controller 113 and examples of a notification command transmitted to the print unit 107. FIG. 8A illustrates processing of video count values. In FIG. 8A, an individual video count value (hereinafter, a register read value) acquired by the image processing unit 115 and stored in the register 123 is 32-bit data. In the present exemplary embodiment, instead of directly notifying the print unit 107 of a video count value read from the register 123, the controller 113 notifies the print unit 107 of a video count value after converting the video count value into 16-bit data. More specifically, the controller 113 adds up a 32-bit register read value and a 16-bit value carried over from the previous page, notifies the print unit 107 of the upper 16-bit value of the resultant video count value, and carries over the lower 16-bit value to the processing of the next page.

For example, when a register read value is 0x00030105 and the 16-bit value carried over from the previous page is 0x5678, the sum is 0x0003577D. In this case, the controller 113 notifies the print unit 107 of the upper 16-bit value 0x0003. In addition, the controller 113 stores the lower 16-bit value 0x577D carried over in the memory 102 or the storage unit 103. When the next page is processed, the controller 113 calls up the lower 16-bit value 0x577D and performs the addition in the same way.

When the register read value is 0x0003FFFF and the 16-bit value carried over from the previous page is 0x5678, the sum is 0x00045677. In this case, the controller 113 notifies the print unit 107 of the upper 16-bit value 0x0004. In addition, the controller 113 stores the lower 16-bit value 0x5677 carried over in the memory 102 or the storage unit 103. When the next page is processed, the controller 113 calls up the lower 16-bit value 0x5677 and performs the addition in the same way.

In this way, by performing rounding processing focusing on the upper bit value of a register read value, the print unit 107 is notified of a reduced amount of data. Since the controller 113 rounds off a fraction about a target page, the added amount of toner is smaller than the amount of toner actually consumed. However, since the fraction is carried over to the processing of the next page, the difference is compensated.

FIG. 8B illustrates a configuration example of a notification command, which is a command for notification of a video count value of a single color. An individual notification command of which the controller 113 notifies the print unit 107 includes "command number", "command size", "color", and "count value" fields. Each box in FIG. 8B represents 1-byte data. The command number field is represented by 2-byte data and indicates that the command number is 0xA0A1. The command size field represents the entire data amount of the command including the command number, and the data amount of the command in FIG. 8B is 6 bytes. The color field represents a color by using the lower 4-bit of 1 byte. In FIG. 8B, 0x01 represents black (K). The count value field represents a count value calculated as illustrated in FIG. 8A.

FIG. 8C illustrates a configuration example of a notification command when the print unit 107 is a color printer that outputs four colors of yellow (Y), magenta (M), cyan (C), and black (K). Similar to FIG. 8A, a count value is calculated for each of the individual colors YMCK. In FIG. 8C, 0x0001, 0x001E, 0x000A, and 0x0003 are calculated for Y, M, C, and K, respectively. The notification command in FIG. 8C differs from that in FIG. 8B in that a count value field is provided per color and that the notification command is 12-byte data.

Even when the print unit 107 is a multicolor printer, when certain printing, such as monochrome printing is specified, the controller 113 can transmit a notification command indicating a toner replenishment amount about a certain output color. The operation according to the present exemplary embodiment can be performed when a certain print mode, for example, a high-image quality print mode, is specified.

In the present exemplary embodiment, as illustrated in FIGS. 8A to 8C, the controller 113 does not directly notify the print unit 107 of 32-bit data stored as a register read value. Instead, the controller 113 notifies the print unit 107 of a smaller data amount by focusing on the upper bit value of the 32-bit data. In this way, the data communication amount between the controller 113 and the print unit 107 can be reduced.

Figure 9:
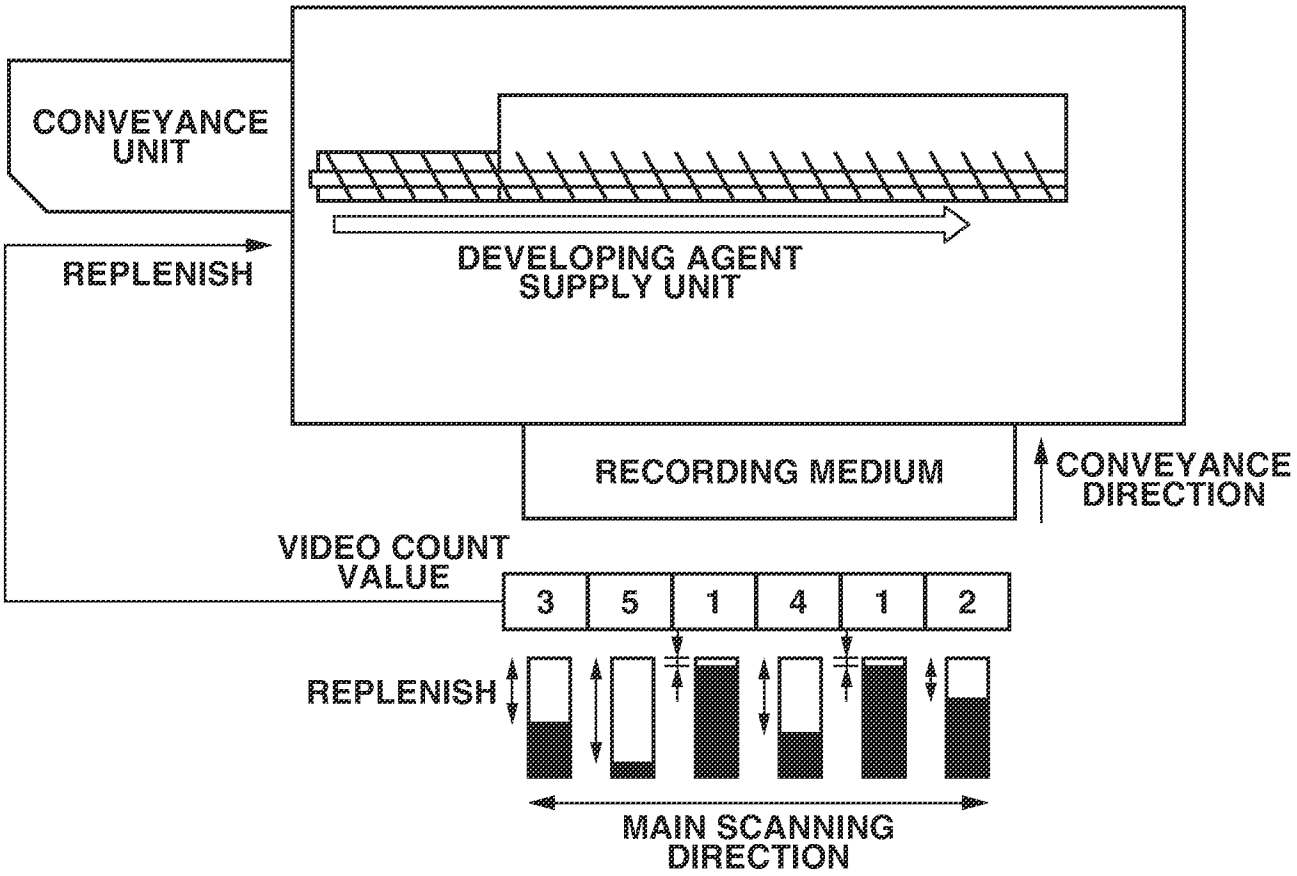
FIG. 9 schematically illustrates replenishment of toner agent.

FIG. 9 and FIGS. 10A to 10C illustrate processing of video count values and examples of a notification command when a video count value is acquired from each of the areas arranged in the main scanning direction as illustrated in FIG. 2B. FIG. 9 illustrates an example in which the replenishment control processing illustrated in FIG. 6 is performed based on video count values respectively corresponding to six areas arranged in the main scanning direction.

While FIG. 9 differs from FIG. 6 in that an individual area 203 is divided into six areas arranged in the main scanning direction, the replenishment control processing performed on each of the areas is the same as that described with reference to FIG. 6. For example, the configuration as illustrated in FIG. 9 is applicable to a case where a plurality of developing agent supply units is arranged in the main scanning direction. As illustrated in FIG. 9, the print unit 107 is notified of toner consumption amounts 3, 5, 1, 4, 1, and 2, which are the amounts consumed by the respective developing agent supply units and which correspond to the respective areas arranged in the main scanning direction.

Figure 10A:
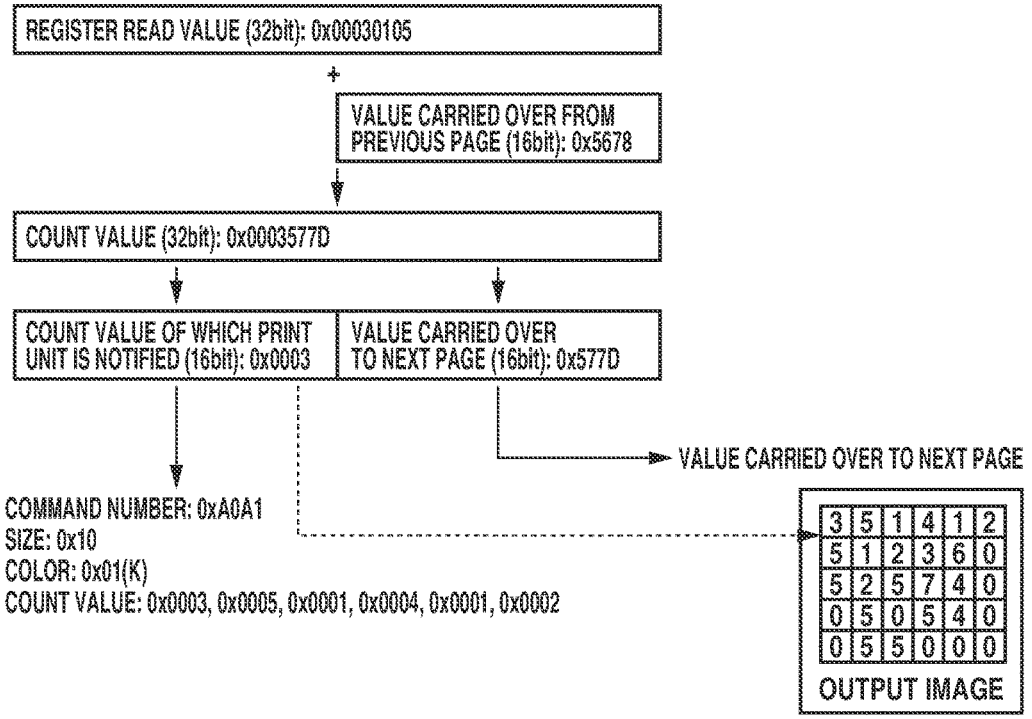
FIGS. 10A to 10C illustrate notification commands.
Figure 10B:
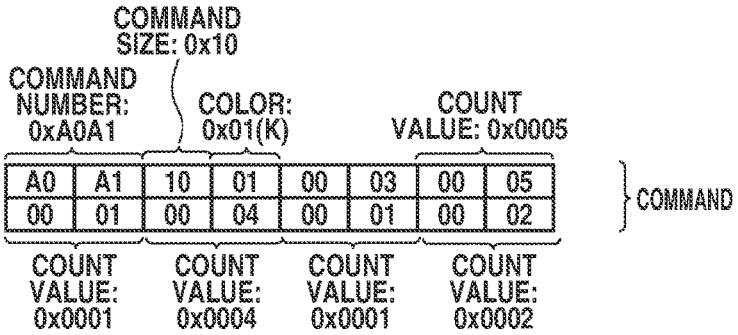
Figure 10C:
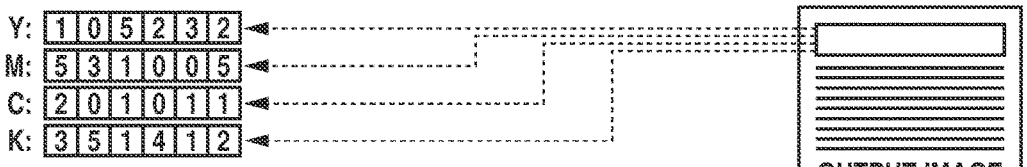

FIGS. 10A to 10C illustrate video count value processing performed by the controller 113 and examples of a notification command transmitted to the print unit 107 when a video count value is acquired from each of the areas arranged in the main scanning direction as illustrated in FIG. 2B. The processing of an individual video count value from a corresponding register read value is the same as that described with reference to FIG. 8A. However, in FIG. 10A, the video count values acquired from the respective six areas, which are obtained by dividing a single area illustrated in FIG. 8A in the vertical direction in FIG. 8A, are stored in the register 123.

In the case illustrated in FIG. 10A, each time a single interrupt signal is detected in step S306 in FIG. 3, the CPU 101 reads the register read values of the six areas and calculates the respective count values (toner replenishment amounts). In FIG. 10A, the video count values of the calculated areas are 0x0003, 0x0005, 0x0001, 0x0004, 0x0001, and 0x0002, respectively.

FIG. 10B illustrates a configuration example of a notification command based on the count values illustrated in FIG. 10A. While the configurations of the fields are the same as those illustrated in FIG. 8B, the count value field is expanded to cover the six areas. Accordingly, the command size is also larger than that illustrated in FIG. 8B.

FIG. 10C illustrates a configuration example of a notification command when the print unit 107 is a color printer that outputs four colors of YMCK. As illustrated in FIG. 10C, a count value corresponding to an area is acquired for each of the colors YMCK. While the configurations of the command is also the same as those illustrated in FIG. 8C, the count value field is expanded to cover a total of 24 areas (each of the six areas is represented by the four colors YMCK). By notifying the print unit 107 of these commands, each of the developing agent supply units of the respective colors arranged in the main scanning direction can be replenished with an appropriate amount of toner agent.

OTHER EMBODIMENTS

Embodiment(s) can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While exemplary embodiments have been described, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

at least one controller, having at least one processor which executes instructions stored in at least one memory being configured to:

acquire, in a case where a predetermined interruption signal is detected while image data is transmitted to an image forming unit, first information indicating an amount of recording material to be used for performing an image forming of a part of a page, wherein the first information is stored in a register; and notify, based on the acquired first information, the image forming unit of second information for determining an amount to be supplied to a development unit of the image forming unit.

2. The image forming apparatus according to claim 1, wherein the recording material is toner.

3. The image forming apparatus according to claim 1, wherein the first information is generated based on a density of a pixel in image data in the part of the page.

4. The image forming apparatus according to claim 1, wherein the first information and the predetermined interruption signal are acquired from a video count unit which generates the first information.

5. A method for controlling an image forming apparatus, the method comprising:

acquiring, in a case where a predetermined interruption signal is detected while print data is transmitted to an image forming unit, first information for predicting an amount of recording material to be used for performing an image forming of a part of a page, wherein the first information is stored in a register; and notifying, based on the acquired first information, the image forming unit of second information for determining an amount to be supplied to a development unit of the image forming unit.

6. The method according to claim 5, wherein the recording material is toner.

7. The method according to claim 5, wherein the first information is generated based on a density of a pixel in image data in the part of the page.

8. The method according to claim 5, wherein the first information and the predetermined interruption signal are acquired from a video counting which generates the first information.

9. An image forming apparatus comprising:

at least one controller, having at least one circuitry containing logic that causes the circuit to:

acquire, in a case where a predetermined interruption signal is detected while image data is transmitted to an image forming unit, first information indicating an amount of recording material to be used for performing an image forming of a part of a page, wherein the first information is stored in a register; and notify, based on the acquired first information, the image forming unit of second information for determining an amount to be supplied to a development unit of the image forming unit.

10. The image forming apparatus according to claim 9, wherein the recording material is toner.

11. The image forming apparatus according to claim 9, wherein the first information is generated based on a density of a pixel in image data in the part of the page.

12. The image forming apparatus according to claim 9, wherein the first information and the predetermined interruption signal are acquired from a video count unit which generates the first information.

* * * * *